US009694377B2

(12) United States Patent
Michaux

(10) Patent No.: US 9,694,377 B2
(45) Date of Patent: Jul. 4, 2017

(54) FLUID PRODUCT DISPENSER

(71) Applicant: APTAR FRANCE SAS, Le Neubourg (FR)

(72) Inventor: Sebastien Michaux, Caudebec les Elbeuf (FR)

(73) Assignee: APTAR FRANCE SAS, Le Neubourg (FR)

( * ) Notice: Subject to any disclaimer, the term of this patent is extended or adjusted under 35 U.S.C. 154(b) by 75 days.

(21) Appl. No.: 14/785,149

(22) PCT Filed: Apr. 18, 2014

(86) PCT No.: PCT/FR2014/050946
§ 371 (c)(1),
(2) Date: Oct. 16, 2015

(87) PCT Pub. No.: WO2014/174187
PCT Pub. Date: Oct. 30, 2014

(65) Prior Publication Data

US 2016/0067727 A1 Mar. 10, 2016

(30) Foreign Application Priority Data

Apr. 22, 2013 (FR) ..... 13 53644

(51) Int. Cl.
*B05B 11/00* (2006.01)

(52) U.S. Cl.
CPC ..... *B05B 11/3042* (2013.01); *B05B 11/0018* (2013.01); *B05B 11/0037* (2013.01); *B05B 11/0056* (2013.01); *B05B 11/3001* (2013.01)

(58) Field of Classification Search
CPC ..... B05B 11/0018; B05B 11/0035; B05B 11/0056; B05B 11/3001; B05B 11/3042
See application file for complete search history.

(56) References Cited

U.S. PATENT DOCUMENTS 5,524,680 A * 6/1996 de Laforcade ..... B05B 11/0037 141/113
5,791,527 A * 8/1998 Giuffredi ..... B05B 11/0056 141/113

(Continued)

FOREIGN PATENT DOCUMENTS

EP 1 896 189 A2 3/2008
FR 2 667 050 A1 3/1992

(Continued)

OTHER PUBLICATIONS

International Search Report for PCT/FR2014/050946 dated Dec. 19, 2014.

(Continued)

*Primary Examiner* — Timothy L Maust
(74) *Attorney, Agent, or Firm* — Sughrue Mion, PLLC

(57) ABSTRACT

A refillable fluid dispenser having a fluid reservoir (1) with a bottom wall (12) provided with an opening (13); a filling valve (2) mounted in the opening and that includes a movable member (26) and a valve seat (21); a dispenser member (4) having an actuator rod (44) and a vent system, the actuator rod (44) movable axially between a rest position and a depressed position and the vent system closed in the rest position and open in the depressed position; and a pusher (6) mounted on the actuator rod (44). The fluid dispenser includes an abutment mechanism (76) for holding the pusher (6) when pressure exerted on the filling valve (2) is transmitted to the dispenser member (4) so as to move the dispenser member body (41) relative to its actuator rod (44) to bring it into its depressed position in order to open the vent passage.

9 Claims, 2 Drawing Sheets

(56) References Cited

U.S. PATENT DOCUMENTS

| | | | | |
|---|---|---|---|---|
| 7,743,949 | B2 * | 6/2010 | Ramet | B05B 11/0051 141/23 |
| 8,695,896 | B2 * | 4/2014 | Tu | B05B 11/0056 141/113 |
| 8,783,523 | B2 * | 7/2014 | Dumont | B05B 11/0032 141/113 |
| 9,266,132 | B2 * | 2/2016 | Dumont | A45D 34/02 |

FOREIGN PATENT DOCUMENTS

| | | | | |
|---|---|---|---|---|
| FR | EP 2977110 | A1 * | 1/2016 | B05B 11/0037 |
| GB | 2 229 380 | A | 9/1990 | |
| WO | 2009/047116 | A1 | 4/2009 | |

OTHER PUBLICATIONS

International Preliminary Report on Patentability dated Aug. 24, 2016, issued by the International Bureau in corresponding International Application No. PCT/FR2014/050946.

* cited by examiner

FLUID PRODUCT DISPENSER

CROSS REFERENCE TO RELATED APPLICATIONS

This application is a National Stage of International Application No. PCT/FR2014/050946 filed Apr. 18, 2014, claiming priority based on French Patent Application No. 1353644 filed Apr. 22, 2013, the contents of all of which are incorporated herein by reference in their entirety.

The present invention relates to a refillable fluid dispenser comprising:

a fluid reservoir defining a neck and a bottom wall provided with an opening that is arranged remote from the neck;

a filling valve that is mounted in the opening of the bottom wall, the filling valve including a movable member and a valve seat for the movable member;

a dispenser member, such as a pump, mounted on the neck of the reservoir for taking the fluid, the dispenser member comprising a body and an actuator rod that is axially movable down and up, the dispenser member incorporating a vent system making it possible to establish selectively a vent passage between the reservoir and the outside through the dispenser member, the actuator rod being movable axially between a rest position and a depressed position, the vent passage being closed in the rest position and open in the depressed position; and a pusher that is mounted on the actuator rod of the dispenser member.

An advantageous field of application of the present invention is the field of perfumery, without forgetting the fields of cosmetics and pharmacy.

In the prior art, document EP 1 896 189 is already known that describes a refillable dispenser comprising a reservoir provided with a filler valve and with a pump surmounted by a pusher. The pump incorporates a vent system in the form of a vent passage that extends through the body of the pump. More precisely, the pump body forms a vent hole that communicates with the outside through the pump body when the actuator rod of the pump is slightly depressed. In that document, provision is made to block the pusher in its slightly depressed position by means of a blocking member that is in the form of a slider. Before proceeding to the filling stage, the user needs to depress the pusher beforehand, to hold it depressed, to move the slider, then to release the pusher so that it returns to a slightly depressed position, making it possible to open the vent passage that extends through the pump. The user may then commence the filling operation through the filling valve. With that refillable dispenser of the prior art, it is necessary to open the vent passage beforehand, by blocking the pusher, otherwise filling cannot be performed. That thus requires the user to perform an operation prior to filling. Furthermore, it is necessary for the user to understand that the prior operation is essential, thus forcing the user to read the instructions attentively. None of that contributes to ease of use.

An object of the present invention is to remedy the above-mentioned drawbacks of the prior art by defining a refillable dispenser having venting that passes through the dispenser member (pump or valve), without any prior operation of opening the vent passage. An object of the present invention is to cause the vent passage to open automatically when the filling operation begins.

To achieve these objects, the present invention proposes that the dispenser further comprises abutment means for holding the pusher when pressure exerted on the filling valve is transmitted to the dispenser member in such a manner as to move the body relative to its actuator rod so as to bring it into its depressed position in order to open the vent passage. In other words, the pusher is blocked and the reservoir is moved towards the blocked pusher by pressing on the filling valve in such a manner as to depress the actuator rod a little and open the vent passage. In this way, each time pressure is exerted on the filling valve, the vent passage opens, and the air contained in the reservoir escapes through the vent passage as the reservoir is filled with fluid through the filling valve.

In an advantageous embodiment, the abutment means are formed by a manual grip member in which the reservoir is slidably mounted, the abutment means comprising an inwardly-directed rim against which the pusher comes to bear, in particular when pressure is exerted on the filling valve. Thus, the user takes hold of the dispenser with one hand via the manual grip member, and fits the actuator rod of a source flask held in the other hand against the filling valve, so as to proceed to the filling operation. In so doing, the reservoir is moved successively inside the manual grip member, thereby causing the vent passage to open in succession. Advantageously, the manual grip member is in the form of a casing that can be held with one hand, the pusher forming a bearing flange that is engaged below the inwardly-directed rim. Thus, when the reservoir is pushed towards the pusher, said pusher is blocked by the inwardly-directed rim of the casing, thereby causing the actuator rod to be depressed and the vent passage to be opened.

According to another advantageous characteristic of the invention, the reservoir is slidably mounted in the manual grip member to slide over a limited axial stroke that defines a high position and a low position of the reservoir in the manual grip member, the actuator rod being in its rest position when the reservoir is in its low position, and in its depressed position when the reservoir is in its high position. Advantageously, the manual grip member includes an inside annular groove, and the reservoir includes at least one projecting outside lug that is received in the inside annular groove in such a manner as to be capable of being moved therein over said limited axial stroke. The reservoir is thus held captive in the casing, although it can move axially over a limited stroke that corresponds to the lugs moving axially inside the groove. The high position of the reservoir suffices to depress the actuator rod a very small amount so as to open the vent passage, naturally without causing fluid to be dispensed.

According to another advantageous characteristic of the invention, the dispenser further comprises a cap for covering and protecting the filling valve, the cap being mounted in removable manner on the reservoir, coming into engagement with the manual grip member in such a manner as to push the reservoir into its low position. Preferably, the cap is screw-fastened on the reservoir and includes a top annular edge that comes into axial thrust contact against the manual grip member. The cap thus performs two functions, namely a conventional function of protecting the filling valve, and a more inventive function of urging the reservoir into its low position inside the manual grip member (casing).

In another advantageous aspect of the invention, the vent system comprises a vent hole that passes through the body, and a valve gasket that is arranged around the actuator rod and that is advantageously secured to a ferrule that is engaged in stationary manner in the body, the valve gasket co-operating with the actuator rod to create a seal when the actuator rod is in its rest position, and opening the vent passage when the actuator rod is in its depressed position. It is not necessary to depress the actuator rod far into the body of the dispenser member in order to open the vent passage: a slight depression of about one tenth of a millimeter normally suffices to open the vent passage.

In another advantageous aspect of the invention, the vent passage of the dispenser member opens out into a space that communicates with the outside at the abutment means. The space may possibly be used to collect fluid that has passed through the vent passage, in particular during excessive filling. The space is confined, in particular because it communicates with the outside between the casing and the pusher.

According to another advantageous characteristic of the invention, the movable member of the filling valve comprises a flexible diaphragm that selectively bears in leaktight manner against the valve seat, forming an upstream filling channel that extends from a reception housing for receiving the nozzle of a source bottle.

The spirit of the invention resides in the reservoir being vented through the vent system of the dispenser member at the same time as it is being filled, with the opening of the vent system not requiring any prior operation. The vent passage is opened only during a stage of injecting fluid through the filling valve. Sliding the reservoir in the casing that blocks the pusher, enables the actuator rod to be depressed in a manner that is sufficient to open the vent passage. When the pressure on the filling valve ceases, the vent passage closes automatically.

The invention is described more fully below with reference to the accompanying drawings, which show an embodiment of the invention by way of non-limiting example.

Figure 1:
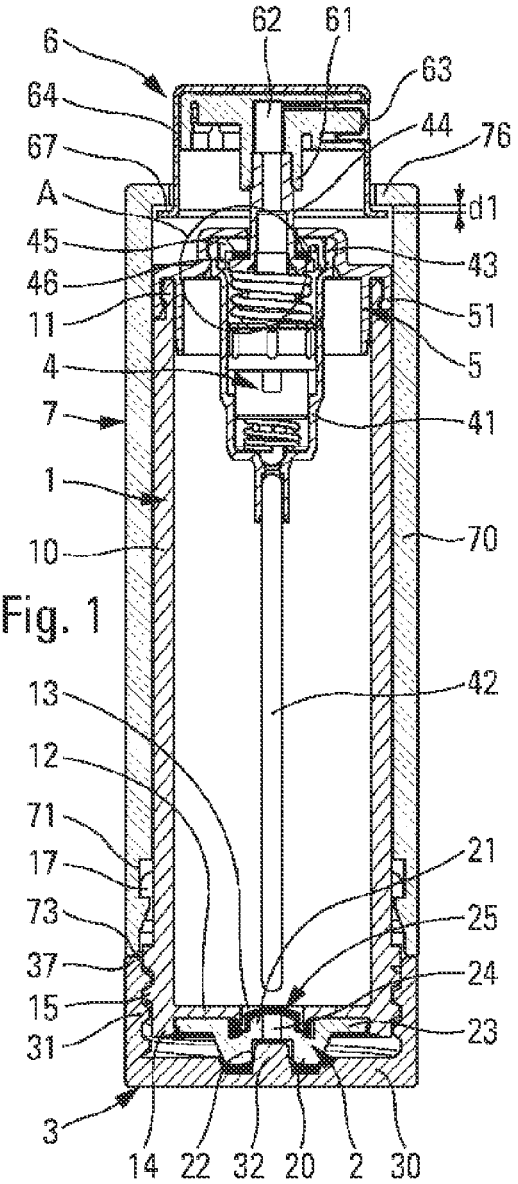
FIG. 1 is a vertical section view through a dispenser of the invention with its cap in place.

The dispenser comprises the following component elements, namely a fluid reservoir 1, a filling valve 2, a removable cap 3, a dispenser member 4, a fastener ring 5, a pusher 6, and a casing 7.

The fluid reservoir 1 comprises a cylinder 10 that is generally cylindrical. At its top end, the cylinder 10 defines a neck 11. At its bottom end, the cylinder 10 forms a bottom wall 12 that is provided with an opening 13 that is advantageously arranged in central manner. The bottom wall 12 forms an annular flange 14 having a function that is explained below. On its outer wall, the cylinder 10 forms a thread 15 and one or more projecting outside lugs 17 that may be formed just above the thread 15. In place of the lugs 17, a continuous annular bead could be provided. The opening 13 passes right through the bottom wall 12, such that the inside of the reservoir 1 can communicate with the outside through the opening.

The filling valve 2 is mounted in the bottom wall 12 of the reservoir and extends mainly through the central opening 13. The filling valve 2 is formed by a stationary element 20 and a flexible part 25. In very general manner, the stationary element 20 forms a valve seat 21, and the flexible part 25 forms a movable member 26 that bears in selective and leaktight manner against the valve seat 21. In the absence of any fluid under pressure, the movable member 26 bears in leaktight manner against the seat 21. When the movable member is subjected to fluid presenting sufficient pressure, it lifts off from its seat in such a manner as to create a passage making it possible to connect the outside of the reservoir to the inside of the reservoir. In a variant, the movable member may be lifted off from its seat mechanically, e.g. by the actuator rod of a source bottle.

Figure 4:
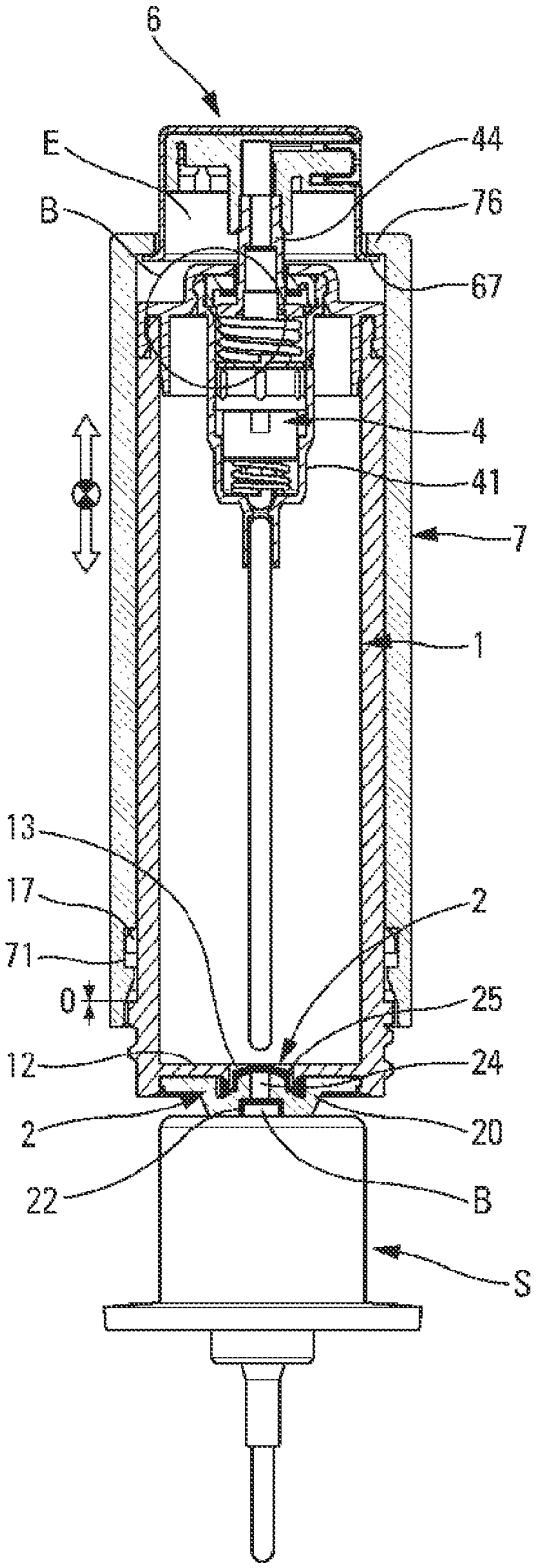
FIG. 4 is a view similar to the view in FIGS. 1 and 2 during a filling operation.

In greater detail, the flexible part 25 includes a flexible diaphragm 26 that presents a slot, e.g. in the shape of a cross. The flexible diaphragm 26 is surrounded by an annular anchor band 27 that is for bearing against the bottom wall 12. The top face of the diaphragm 26 is oriented towards the inside of the reservoir 1. Its bottom face bears against the valve seat 21 formed by the stationary element 20. More precisely, the stationary element 20 includes a rim 23 that is received in the annular flange 14. The rim 23 comes into contact with the anchor band 27 of the movable member 25 and pushes it hard against the edge of the opening 13. Thus, the flexible part 25 is held in stationary and leaktight manner inside the opening 13. The stationary element 20 also forms the valve seat 21 that comes into contact with the bottom face of the flexible diaphragm 26. The valve seat 21 may be in the form of a stud that is arranged coaxially inside the rim 23. A filling channel 24 passes through the seat 21, which channel extends below the diaphragm 26 from a reception housing 22 for receiving the actuator rod B of a source bottle S, as can be seen in FIG. 4.

In the rest state, the flexible diaphragm 26 bears in leaktight manner against the valve seat 21. In FIG. 4, the free end of an actuator rod B of a dispenser member that forms part of a source bottle S is engaged inside the reception housing 22. By pressing the actuator rod B hard into the housing 22, the dispenser member is actuated and fluid under pressure is forced through the actuator rod in such a manner as to flow under pressure through the channel 24 so as to reach the bottom face of the flexible diaphragm 26 that is then lifted, widening its slot. The fluid may then penetrate into the reservoir 1. It should be observed that, in this embodiment, the filling valve 2 is opened under the action of the fluid under pressure, but the valve could also be opened by direct mechanical pressure exerted by the actuator rod B.

The removable cap 3 includes a bottom wall 30 that is provided with a stud 32 for penetrating into the housing 22, and with an O-ring 33 for being flattened against the edge of the housing 22 in such a manner as to close the channel 24 in leaktight manner. In order to compress the O-ring 33, the cap 3 includes a threaded skirt 31 that may come into engagement with the outside thread 15 of the body 1, as can be seen very clearly in FIG. 1. The threaded skirt 31 defines a top annular edge 37 having a function that is explained below.

Figure 3:
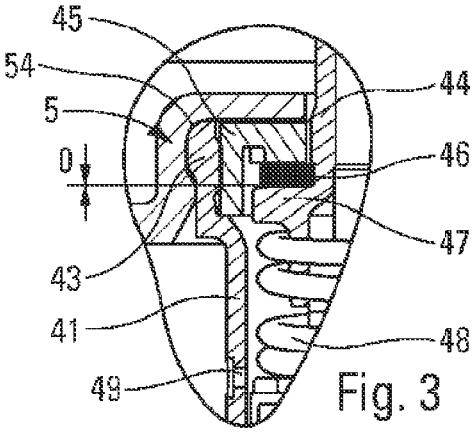
FIG. 3 is a much larger-scale view of a detail A of FIGS. 1 and 2.
Figure 5:
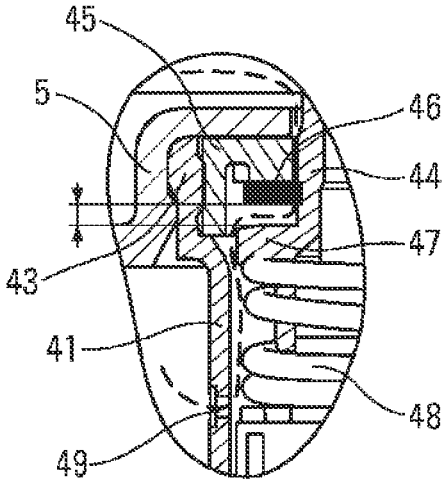
FIG. 5 is a much larger-scale view of a detail B of FIG. 4.

By way of example, the dispenser member 4 may be a pump comprising a pump body 41 that is provided at its bottom end with a dip tube 42 and at its top end with a holding collar 43. The body 41 is perforated with a vent hole 49 that forms an integral part of a vent system, making it possible to put the inside of the reservoir 1 into communication with the outside. The pump also comprises an actuator rod 44 that is axially movable down and up inside the body 41, in such a manner as to cause the volume of a pump chamber (not shown) to vary. The rod 44 is urged into its rest position by a return spring 48, against a valve gasket 46 that is supported by a ferrule 45 that is engaged in stationary manner in the body 41. A function of the valve gasket is to guarantee that the dispenser member is sealed in its rest position. More precisely, the rod 44 forms a shoulder 47 against which the gasket 46 is flattened by the spring 48 in the rest position, as can be seen in FIG. 3. When the rod is depressed in full or in part into the body against the spring 48, the gasket 46 is lifted off from the shoulder 47, and the seal between the rod 44 and the gasket 46 is thus broken, as shown in FIG. 5. When the rod is in its depressed position (seal broken), the inside of the reservoir 1 communicates with the outside through the vent hole 49, between the shoulder 47 and the gasket 46, then through the gasket 46, as shown in FIG. 5 by dashed lines. Air may thus penetrate into the reservoir as the fluid is extracted therefrom by the dispenser member. This is entirely conventional for a pump provided with a vent system that incorporates a vent passage. In addition, the pump 4 is provided with an inlet valve and with an outlet valve at opposite ends of the pump chamber, such that the fluid can penetrate into the pump chamber through the dip tube 42 and the open inlet valve, and leave the pump chamber through the open outlet valve and the actuator rod 44 when said pump chamber has been put under pressure. This design is entirely conventional for a pump in the fields of perfumery, cosmetics, and pharmacy.

The fastener ring 5 makes it possible to mount the dispenser member 4 in stationary and leaktight manner in the reservoir 1. The fastener ring may even be incorporated with the dispenser member 4. The fastener means comprise: reception means 54 for receiving the holding collar 43 of the body 41 in stationary and stable manner; a fastener skirt 51 that is in engagement with the neck 11 of the reservoir; and a plate 52 that can come into abutment against the top end of the reservoir. The particular design of the fastener ring 5 is not critical to the present invention.

The pusher 6 is mounted on the free end of the actuator rod 44 of the dispenser member 4. It includes a connection sleeve 61 that is engaged on the free end of the actuator rod 44. The connection sleeve 61 is extended by an inner duct 62 that leads to a dispenser orifice 63, e.g. in the form of a spray nozzle. This general design is entirely conventional for a pusher in the fields of perfumery, cosmetics, and pharmacy. In the invention, the pusher includes a cover 64 that, at its bottom end, forms an annular bearing flange 67 that projects radially outwards. The flange may be continuous or segmented.

The casing 7 presents a configuration that is generally substantially cylindrical, with a main body 70 and an inwardly-directed rim 76 at its top end. The main body 70 includes an annular bottom edge 73, and forms an inside annular groove 71 in the proximity of the bottom edge 73.

Figure 2:
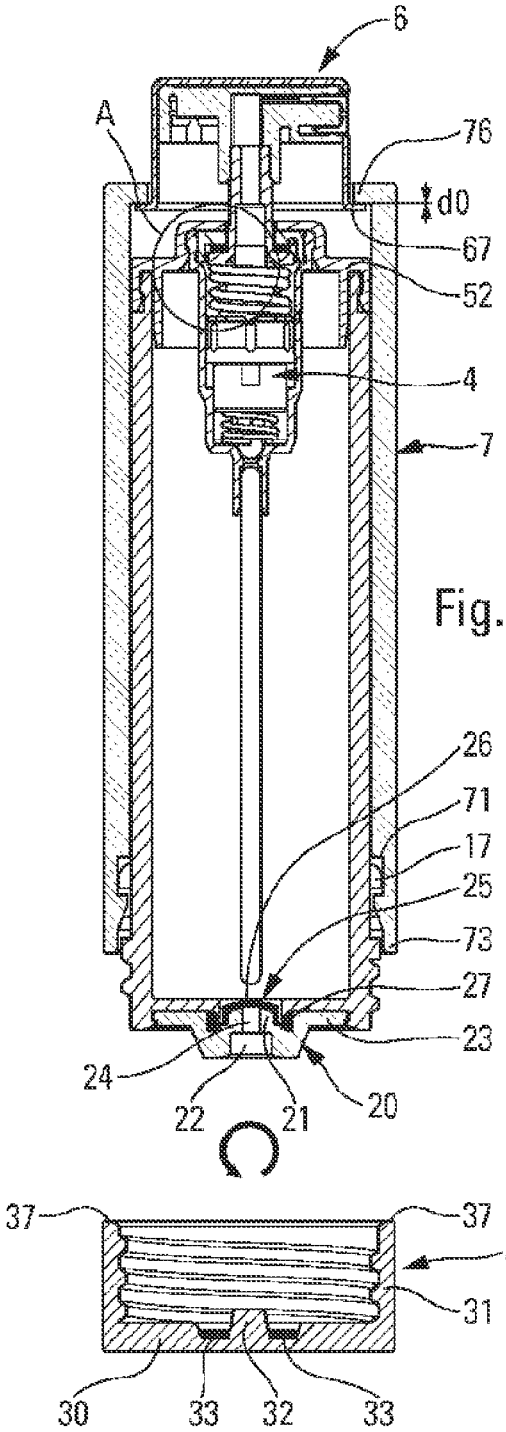
FIG. 2 is a view similar to the view in FIG. 1, with the cap removed.

The reservoir 1 is arranged inside the casing 7 with limited clearance: the projecting outside lugs 17 of the reservoir 1 are received in the annular groove 71 of the casing, such that the reservoir 1 is held captive in the casing 7. The lugs 17 present an axial height that is less than the axial height of the groove 71, such that the lugs can move axially in the groove 71 over a limited stroke. As a result, the reservoir can slide axially in the casing over a limited axial stroke between a low position (FIG. 1) and a high position (FIG. 4). When the cap 3 is screw-fastened fully on the reservoir, as shown in FIG. 1, its top annular edge 37 comes into engagement with the bottom edge 73 of the casing and thus pushes the reservoir into its low position. It can be said that the cap 3 forces the reservoir into its low position and blocks it there. When the cap is removed, as can be seen in FIG. 2, the reservoir is released and can be moved in the casing: the lugs 17 may have an intermediate position in the groove 71. Then when the rod B of a source bottle S is pushed into the reception housing 22 of the filling valve 2, as shown in FIG. 4, the reservoir is urged into its high position.

The pusher 6 is secured to the actuator rod 44 of the dispenser member 4 that is mounted in stationary manner on the reservoir 1 by means of the ring 5. The annular bearing flange 67 of the pusher 6 is arranged below the inwardly-directed rim 76 of the casing 7. As a result, the pusher is held captive in the casing, since the reservoir itself is also held captive in the casing. As a function of the position (low, intermediate, or high) of the reservoir in the casing, the flange 67 is at a distance from, rests below, or is pressed against the inwardly-directed rim 76. In FIG. 1, the flange 67 is spaced apart from the rim 76, forming a small gap d1, such that the actuator rod 44 is not depressed and remains in its rest position, while the reservoir is in its low position. The vent passage remains closed, as is visible in FIG. 3. In FIG. 2, the reservoir 1 is freed from urging the cap 6, such that the flange 67 can rest lightly against the rim 76, but without depressing the actuator rod 44 that remains in its rest position. The vent passage is still closed, as is visible in FIG. 3. In FIG. 4, the reservoir is pushed into its high position, such that the flange 67 is pressed hard against the rim 76, thereby causing the actuator rod 44 to be depressed a little. The vent passage is then open, as is visible in FIG. 5. It should be observed that the vent passage of the dispenser member 4 opens out into a space E that communicates with the outside between the pusher 6 and the casing 7 at the flange 67 and the rim 76. The space E is thus confined between the ring 5, the casing 7, and the pusher 6, and may possibly be used as a fluid collection space, in particular when excessive filling causes fluid to pass through the vent passage. This avoids the user's fingers being covered in fluid, since the fluid remains confined in the space E.

In the configuration shown in FIG. 1, the dispenser may be used in conventional manner by actuating the pusher 6 so as to dispense doses of fluid. Once empty, the removable cap 3 may be removed (FIG. 2) and the actuator rod B of a source bottle S may be inserted into the reception housing 22, as shown in FIG. 4. It then suffices to depress the actuator rod B so as to dispense successive doses of fluid, which doses are injected into the reservoir through the filling valve 2, in which the flexible diaphragm 26 has been forced into its open state. Each time fluid is injected, the reservoir 1 is pushed into its high position and the pusher 6, that is urged against the rim 76 of the casing, depresses the actuator rod 44 a little, in such a manner as to open the vent passage.

Thus, air can be evacuated from the reservoir as it is being filled via the filling valve 2. Between each injection stage, the vent passage closes and remains closed when the filling operation is completed. The vent system of the dispenser member is thus used to vent the reservoir during filling. This does not require any prior operation: merely sliding the reservoir 1 in the casing 7 and pressing the pusher 6 against the rim 76 suffice to open the vent passage. The user needs only to take hold of the casing 7 with one hand, and fit the rod B of the source bottle S into the reception housing 22 of the filling valve 2 with the other hand. The casing thus constitutes a manual grip member 7 that is provided with abutment means 76 formed by the inwardly-directed rim.

By means of the present invention, it is possible to vent the reservoir of a refillable dispenser through the vent system of the dispenser member without even realizing it, since no prior operation is necessary in order to open the vent passage of the vent system. The sliding of the reservoir in the casing, which makes it possible to depress the actuator rod a little, is not noticeable to the user. In addition, the cap advantageously makes it possible to block the reservoir in the casing during the fluid dispensing stages.

The invention claimed is:

1. A refillable fluid dispenser comprising:

a fluid reservoir defining a neck and a bottom wall provided with an opening that is arranged remote from the neck;

a filling valve that is mounted in the opening of the bottom wall, the filling valve including a movable member and a valve seat for the movable member;

a dispenser member, such as a pump, mounted on the neck of the reservoir for taking the fluid, the dispenser member comprising a body and an actuator rod that is axially movable down and up, the dispenser member incorporating a vent system making it possible to establish selectively a vent passage between the reservoir and the outside through the dispenser member the actuator rod being movable axially between a rest position and a depressed position, the vent passage being closed in the rest position and open in the depressed position; and a pusher that is mounted on the actuator rod of the dispenser member;

the fluid dispenser being characterized in that it further comprises abutment means for holding the pusher when pressure exerted on the filling valve is transmitted to the dispenser member in such a manner as to move the body relative to its actuator rod so as to bring it into its depressed position in order to open the vent passage, the abutment means being formed by a manual grip member in which the reservoir is slidably mounted, the abutment means comprising an inwardly-directed rim against which the pusher comes to bear, in particular when pressure is exerted on the filling valve.

2. A dispenser according to claim 1, wherein the manual grip member is in the form of a casing that can be held with one hand, the pusher forming a bearing flange that is engaged below the inwardly-directed rim.

3. A dispenser according to claim 1, wherein the reservoir is slidably mounted in the manual grip member to slide over a limited axial stroke that defines a high position and a low position of the reservoir in the manual grip member, the actuator rod being in its rest position when the reservoir is in its low position, and in its depressed position when the reservoir is in its high position.

4. A dispenser according to claim 3, wherein the manual grip member includes an inside annular groove, and the reservoir includes at least one projecting outside lug that is received in the inside annular groove in such a manner as to be capable of being moved therein over said limited axial stroke.

5. A dispenser according to claim 3, further comprising a cap for covering and protecting the filling valve, the cap being mounted in removable manner on the reservoir, coming into engagement with the manual grip member in such a manner as to push the reservoir into its low position.

6. A dispenser according to claim 5, wherein the cap is screw-fastened on the reservoir and includes a top annular edge that comes into axial thrust contact against the manual grip member.

7. A dispenser according to claim 1, wherein the vent system comprises a vent hole that passes through the body, and a valve gasket that is arranged around the actuator rod and that is advantageously secured to a ferrule that is engaged in stationary manner in the body, the valve gasket co-operating with the actuator rod to create a seal when the actuator rod is in its rest position, and opening the vent passage when the actuator rod is in its depressed position.

8. A dispenser according to claim 1, wherein the vent passage of the dispenser member opens out into a space that communicates with the outside at the abutment means.

9. A dispenser according to claim 1, wherein the movable member of the filling valve comprises a flexible diaphragm that selectively bears in leaktight manner against the valve seat, forming an upstream filling channel that extends from a reception housing for receiving the nozzle of a source bottle.

* * * * *